United States Patent [19]

Cammack et al.

[11] Patent Number: 4,561,593

[45] Date of Patent: Dec. 31, 1985

[54] SHOWERHEAD

[75] Inventors: Michael A. Cammack; David W. Smith, both of Ft. Collins, Colo.

[73] Assignee: Teledyne Industries, Inc., Fort Collins, Colo.

[21] Appl. No.: 459,137

[22] Filed: Jan. 19, 1983

[51] Int. Cl.[4] ..... B05B 1/16

[52] U.S. Cl. ..... 239/600; 239/443; 239/590

[58] Field of Search ..... 239/443–449, 239/553, 600, 587, 553.3, 590, 590.3

[56] References Cited

U.S. PATENT DOCUMENTS

| | | | |
|---|---|---|---|
| 3,007,648 | 11/1961 | Fraser | 239/460 |
| 3,239,152 | 3/1966 | Bachli et al. | 239/590 |
| 3,786,995 | 1/1974 | Manoogian et al. | 239/449 |
| 3,902,671 | 9/1975 | Symmons | 239/446 |
| 3,999,714 | 12/1976 | Lang | 239/590.3 |
| 4,185,781 | 1/1980 | O'Brien | 239/600 |
| 4,221,338 | 9/1980 | Shames et al. | 239/449 |
| 4,244,526 | 1/1981 | Arth | 239/553 |
| 4,272,022 | 6/1981 | Evans | 239/600 |
| 4,350,298 | 9/1982 | Tada | 239/600 |
| 4,353,508 | 10/1982 | Butterfield et al. | 239/590.3 |

*Primary Examiner*—Jeffrey V. Nase
*Assistant Examiner*—James R. Moon, Jr.
*Attorney, Agent, or Firm*—Hugh H. Drake

[57] ABSTRACT

A showerhead includes a hollow housing with front and rear openings and a closure in the front opening which defines first and second groups of flow outlets. The showerhead is secured to a supply pipe by a nut which has a snout to captivate a ball and fix the position of a shank that projects from the ball and around which the housing is rotatable. A flow control device rotationally fixed on the shank enables selection of liquid flow through the ball and shank to selected ones of first and second channels that lead to corresponding first and second groups of flow outlets as the housing is rotated about the shank.

8 Claims, 12 Drawing Figures

SHOWERHEAD

The present invention pertains to a showerhead. More particularly, it relates to a showerhead that permits adjustment as between a multiplicity of spray patterns, while retaining a high degree of simplicity.

It long has been recognized that users enjoy an adjustability as to the characteristics of a shower spray. A control has heretofore often been included for the purpose of enabling the user to vary between a fine and a coarse spray.

A more recent development has been that of the kind of showerhead which included a feature of emitting a pulsating spray for massage action. Typical examples are those of U.S. Pat. Nos. 3,801,019, 4,303,201 and Canadian Pat. No. 1,089,897. Included among the features of the latter two is the concept of allowing the user to select between a coarse and a fine spray whether pulsating or not.

While the features presented in the aforesaid patents have been well received by the public, the inclusion of such features has led to increased cost for showerheads. Not everyone desires or needs a pulsating spray, for example. Even in the simplest of sprays that are merely adjustable as to spray characteristic, the mechanisms for accomplishing such adjustment have led to undue cost and, at least in some cases, lack of reliability.

In this era of increased interest in conservation of water use, attention also has been directed to the achievement of adequate showering, while at the same time minimizing the use of water. An exemplary approach in that respect is presented in U.S. Pat. No. 4,190,207. Devices constructed in accordance with the disclosure of that patent have now been installed in a widespread number of homes, motels and hotels. It is a showerhead which offers the feature of water conservation as well as the feature of massage action when desired.

While the foregoing developments and improvements have been appreciated both by users and by suppliers, the basic showerhead usually supplied with the original equipment has remained about the same, with or without adjustment of spray force. Thus, a void has existed as between the old-fashioned units and those that are more esoteric in providing such features as massage action.

It is a general object of the present invention to provide a new and improved showerhead which fills that void.

It is another object of the present invention to provide a showerhead which enables the user to achieve the benefit of a multiplicity of spray patterns without incurring significant cost increase for obtaining that result.

It also is an objective of the present invention to obtain such results, while at the same time readily enabling conservation of water useage.

A further object of the present invention is to provide a new and improved unit which enables the user to disable the aforementioned water-saving feature when that is not applicable because of lower water pressure than average.

As to all of the foregoing, the objective is to come up with a device which has consumer-desired features and yet which is so devised that costs are not increased significantly over the older one-function showerheads.

In accordance with the present invention, the showerhead has a generally hollow housing with front and rear openings that lead to the interior thereof. A closure fixed within the front opening defines outlets for directing liquid in a selected spray pattern. A pivot assembly includes a ball joined to a shank, the shank being slidably receivable through the rear opening, and the ball and shank having a conduit defined therethrough for the supply of water or other liquid. A nut connects to a delivery pipe and includes a snout for enveloping the ball. The snout captivates the ball when the latter is urged away therefrom. A seal within the nut urges the ball in order to complete the captivation. The shank is also captivated within the housing.

In another aspect, there is involved such a housing which has a closure affixed within its front opening that defines first and second groups of flow outlets as well as having first and second channels defined therein for enabling the flow of liquid to respective different ones of those groups. Flow control means, fixed within the housing relative to means for securing the housing to a supply pipe, selectively determine the flow path as the housing is rotated around the securing means.

Given such a housing with a hollow interior, and a closure in the front opening that defines means for the delivery of a spray pattern, a further aspect involves a condition for inletting the fluid into the rear opening from a supply pipe, and the inclusion of means disposed in the conduit which includes a user removable restrictor.

The features of the present invention which are believed to be patentable are set forth with particularity in the appended claims. The organization and manner of operation of the invention, together with further objects and advantages thereof, may best be understood with reference to the following description taken in connection with the accompanying drawings, in the several figures of which like reference numerals identify like elements and in which:

Figure 1:
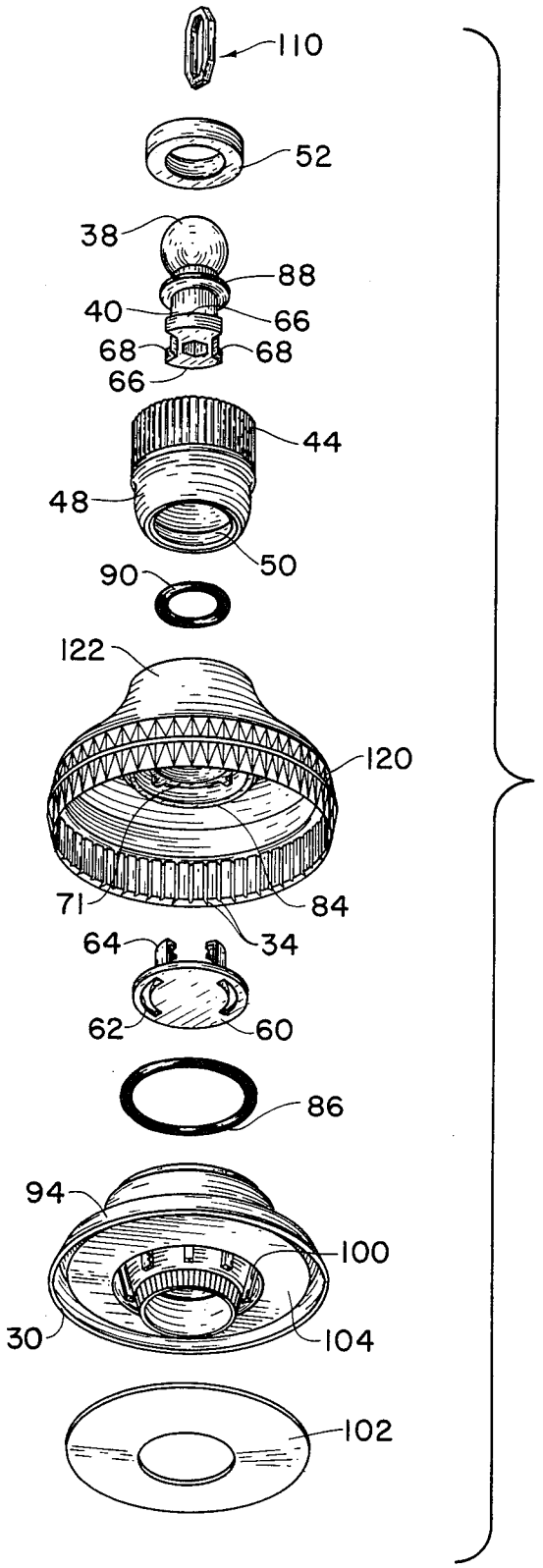
FIG. 1 is an exploded isometric view of a showerhead.

A showerhead 20 includes a generally hollow housing 22 which has a front opening 24 and a rear opening 26 each of which lead to the interior 28 of housing 22.

A closure 30 is affixed within front opening 24 and defines a first set of outlets 32 and a second set of outlets 34, each of which are formed to direct liquid, usually water, in a selected spray pattern outwardly from interior 28. While the liquid in the spray or sprays is usually plain water as received from a supply pipe, it has been suggested heretofore to include some kind of mixing device ahead of the showerhead so as selectively to add another material such as soap, oil or a medicant.

A pivot assembly includes a ball 38 in the form of a generally spherical segment and joined to a shank 40 which projects away from ball 38 and is slidably received through rear opening 26 in protrusion toward fron opening 24. A conduit 42 is defined through ball 38 and shank 40 to deliver water into the interior.

A nut 44 is internally threaded at 46 in its rear portion to enable connection to a water delivery pipe. Nut 44 also includes a snout 48 which envelops ball 38. The internal wall 50 of snout 48 tapers inwardly to captivate ball 38 when the latter is urged outwardly relative to snout 48. A seal 52 not only functions to effect sealing as against leakage of the internally flowing wateer but also urges ball 38 outwardly relative to snout 48 when threads 46 are attached to the supply pipe. An arrangement 54 within the interior of housing 22 serves to captivate shank 40 against withdrawal from rear opening 26. As subsequently will be described in more detail, arrangement 54 serves to seat shank 40 within housing 22 while at the same time permitting rotation of housing 22 around shank 40.

Figure 2:
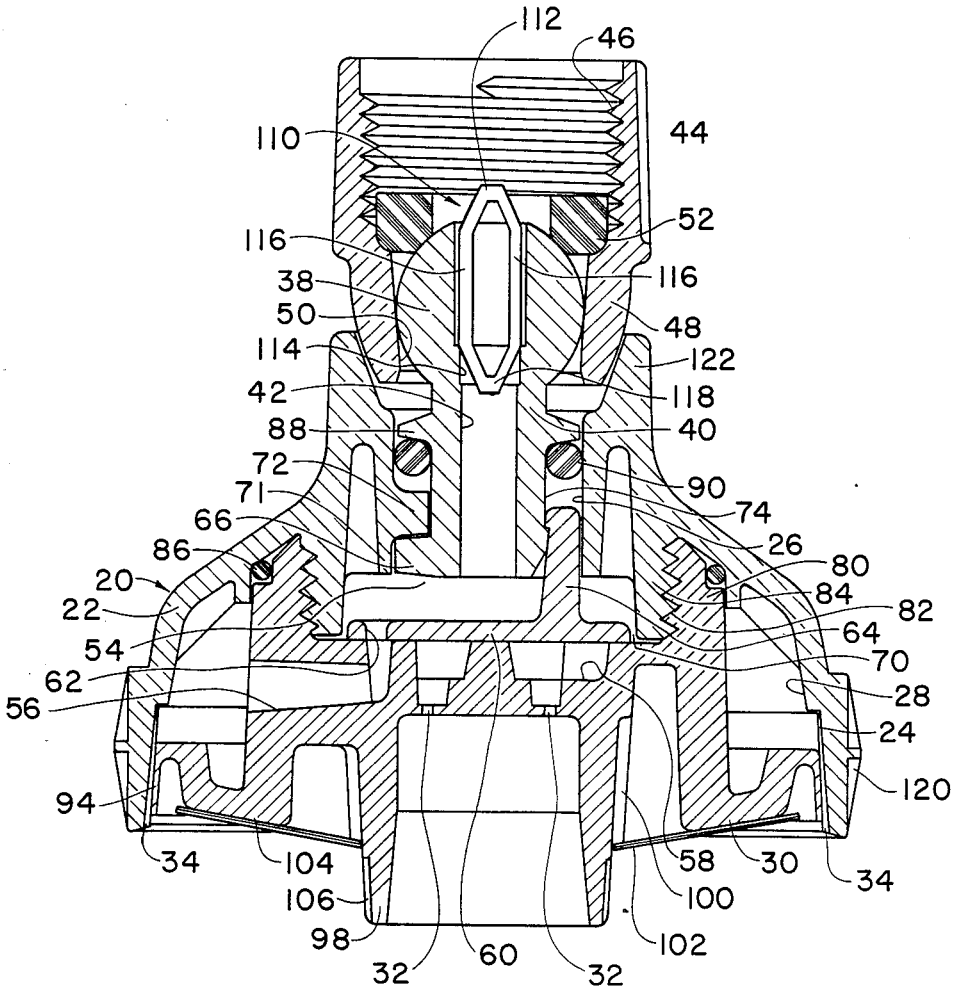
FIG. 2 is an enlarged cross-sectional view of the showerhead of FIG. 1 as assembled, the left half of FIG. 2 being taken at an angle relative to the right half thereof as about a longitudinal axis of the assembly.
Figure 3:
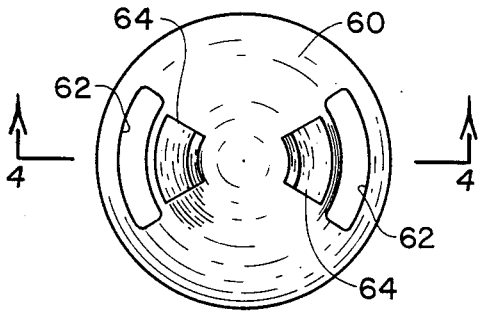
FIG. 3 is a bottom plan view of a component shown in FIG. 1.
Figure 4:
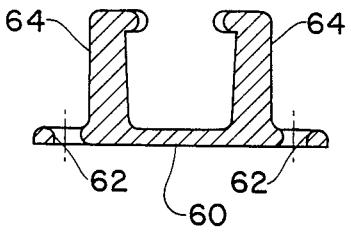
FIG. 4 is a cross-sectional view taken along the line 4—4 in FIG. 3.
Figure 5:
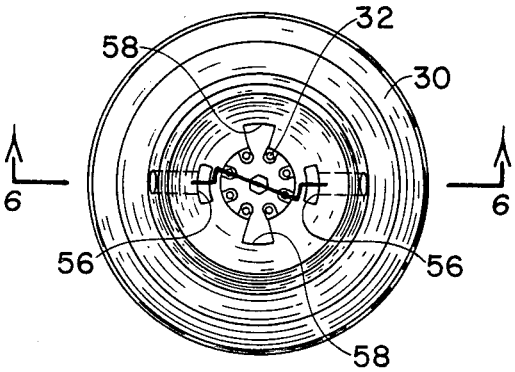
FIG. 5 is a bottom plan view of a component shown in FIG. 1 and taken along the line 5—5 in FIG. 6.
Figure 7:
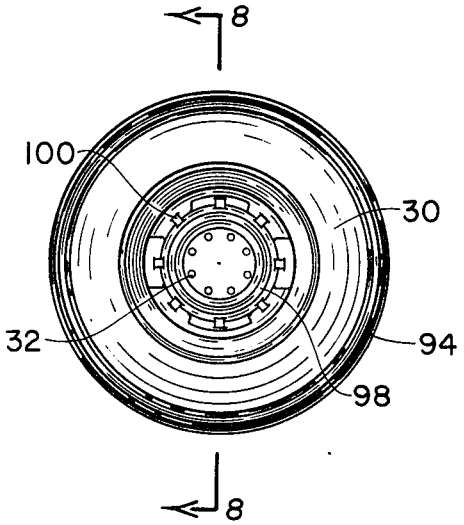
FIG. 7 is a top plan view of the component of FIG. 5 and taken along the line 7—7 in FIG. 8.
Figure 6:
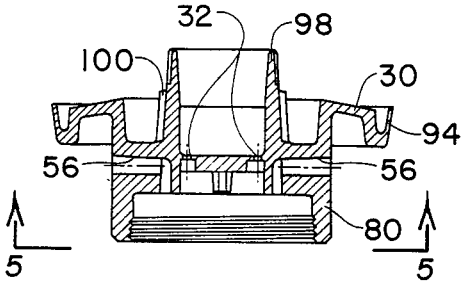
FIG. 6 is a cross-sectional view taken along the line 6—6 in FIG. 5.
Figure 8:
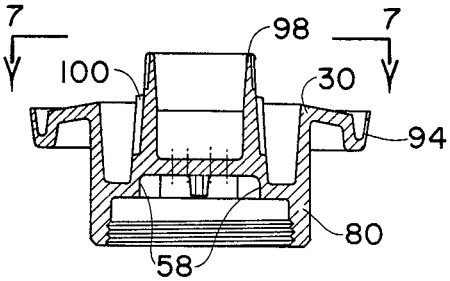
FIG. 8 is a cross-sectional view taken along the line 8—8 in FIG. 7.
Figure 9:
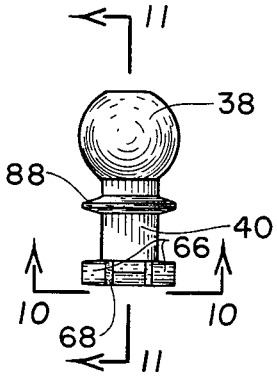
FIG. 9 is a side elevational view of another component shown in FIG. 1 but inverted.
Figure 10:
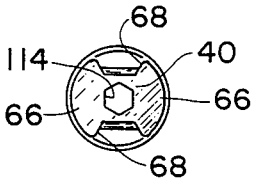
FIG. 10 is a plan view taken along the line 10—10 in FIG. 9.
Figure 11:
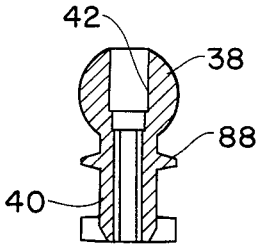
FIG. 11 is a cross-sectional view taken along the line 11—11 in FIG. 9.

Defined within closure 30 are a first pair of space-opposed channels 56 each of which leads outwardly into housing interior 28 for comunication with outlets 34. Also formed in closure 30 are a second pair of space-opposed channels 58 oriented around a longitudinal axis of showerhead 20 at right angles to channels 56. Channels 58 lead to outlets 32. Secured to shank 40 is a flow director or plate 60 which overlies the entrances to channels 56 and 58 and includes space-opposed apertures 62 aligned to be selectively positionable in communication with either channels 56 or 58 as housing 22 is rotated around shank 40. To that end, plate 60 is snap-fitted onto the inner end portion of shank 40 by a pair of space-opposed legs 64. Space-opposed lugs 66 on the inner end portion of shank 40 define a corresponding pair of space-opposed channels 68 into which the individual ones of legs 64 respectively are seated. As best seen in FIG. 2, the free end portions of legs 64 snap behing a shoulder on the inner end portion of shank 40, but legs 64 are movable longitudinally with regard to the shank. In use, however, the force of the incoming water flow through conduit 42 urges plate 60 against the inner face 70 of closure 30.

Projecting inwardly from the wall of housing 22, and more particularly from the inner wall of a nose 71 which defines rear opening 26, are a pair of space-opposed nubs 72 that define a corresponding pair of space-opposed channelways 74 through which lugs 66 are receivable for disposition behind nubs 72 upon insertion and twisting of shank 40 relative to housing 22. It will be observed that legs 64 on plate 60 end up being disposed within channels 68 and channelways 74. Lugs 66 and shank 40 are prohibited from unseating relative to housing 22 by legs 64 that otherwise would enable withdrawal of the shank from the rear opening. Accordingly, the combination of nubs 72 and legs 64 serve as indexing means.

Closure 30 includes a rearwardly-projecting cup 80 threaded internally at 82 to engage mating threads on a forwardly projecting flange 84 which projects forwardly as part of housing 22. An O-ring 86 establishes a seal between closure 30 and flange 84. Intermediate the length of shank 40 is an outwardly projecting flange 88 which captivates an O-ring 90 disposed around shank 40 toward nubs 72 and legs 64.

Outlets 32 are spaced apart circumferentially in a ring. Outlets 34 are, in this case, formed by a series of grooves or slots spaced around the inner peripheral wall of opening 24 and preferably are of alternating angles and depths, so as to create a rather broad outer spray pattern composed of two concentric circular spray patterns. A rim 94 on closure 30 completes the definition of outlets 34.

Projecting forwardly from closure 30 is a spout 98 which surrounds the pattern of spray emmitted from outlets 32. A plurality of inner flutes 100 are spaced circumferentially around the outer wall of spout 98 and have forward ends which serve as a rest against which a decal plate 102 is mounted as well as against a flat surface 104 formed more outwardly on closure 30. Flutes 100 also serve for accepting a tool used in factory assembly or disassembly to permit screwing action at threads 82. More outwardly-located flutes 106 aid the user for achieving access to clean the outlets when, and if, necessary.

A removable restrictor 110 is inserted in conduit 42 for reducing the rate of flow of water into housing 22 as compared with what otherwise would be permitted by the dimensioning of conduit 42 for a given delivered water pressure. Restrictor 110 includes a tab 112 which projects rearwardly from ball 38, allowing a user to remove restrictor 110 when, for his particular pleasure, the outlet flow is insufficient to accomodate his desires. Conduit 42 is of hexagonal shape but defines a cylindrical seat 114 within which restrictor 110 is seated. In its simplest form, restrictor 110 is of an oblong shape and includes a pair of laterally spaced webs 116 that fit into a portion of conduit 42 and continue into tab 112 as well as into an identical longitudinally-opposed tab 118, so that no assembly orientation is required.

Figure 12:
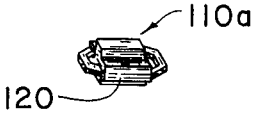
FIG. 12 is an isometric view of an alternative to a component shown in FIG. 1.

Preferably, as shown in FIG. 12, restrictor **110*a* includes a central portion 120 which has a multi-faceted cross-sectional shape, with that portion of conduit 40 being formed to be receptive of such a shape. This enables randomly-selected orientation of the restrictor upon insertion during assembly, and yet insures accessability for removal by the user of the restrictor. In this particular case, central portion 120** is in the shape of a cross.

Assembly of the showerhead is quick and efficient. Shank 40 is inserted through nut 44, and seal 52 is frictionally seated. Shank 40 is then inserted slidably through opening 26, with O-ring 90 in place, and lugs 66 are engaged behind nubs 72 by twisting. Control plate 60 is inserted through hub opening 24 and snapped into place, after which O-ring 86 is installed and closure 30 is threadably engaged. At any convenient time during this procedure, restrictor 110 is inserted.

For installation, the installer simply engages threads 46 on a standard supply pipe and hand-tightens nut 44. Upon that tightening, shank 40 and ball 30 become frictionally engaged to nut 44, so as to substantially be fixed in place.

In taking a shower, the user need only grasp the knurled area 120 around the forward periphery of housing 22 and rotate the housing relative to shank 40. That moves either channels 56 or channels 58 into communication with apertures 62, thus selecting as between outer spray and inner spray.

Legs 64 stop plate 60 rotationally with respect to pivot ball 38 as well as providing a stop for nubs 72, allowing the user to feel a significant increase in rotational resistance by reason of the friction between ball 38, and seal 52 and nut 44. This indicates to the user that the selection of the mode function is complete. At the same time, that feature prevents any breakage of the lugs or the nubs due to user abuse in applying excessive torque to housing 22.

Preferably, restrictor 110 and all internal flow channelling are sized so that the flow characteristics of the shower with restrictor 110 in place meet governmental or other agency flow requirements for showerheads. Should a low pressure condition exist, however, the user may remove restrictor 110 and employ the showerhead in an otherwise normal manner.

It will be appreciated that various alternatives may be incorporated and the aesthetic appearance may be changed. Here, a shroud 122 covers the junction of housing 22 with snout 48. That could be accomplished otherwise. For example, restricter 110 might simply be an insertable cylinder. Control plate 60 may be affixed in another manner, so as to remain stationary with regard to shank 40 as housing 22 is turned. However, the present approach is preferred because control plate 60 not only serves the funtion implied by its name but its legs also serve as part of the securing and locking assembly for the mounting of pivot ball 38 with respect to housing 22.

While a particular embodiment of the present invention has been shown and described, and modifications and alternatives may have been suggested, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. A showerhead comprising:

a generally hollow housing having front and rear openings leading to the interior of said housing;

a closure affixed within said front opening and defining outlets for directing liquid in a selected spray pattern outwardly from said interior;

a pivot assembly including a ball in the form of a generally spherical segment and joined to a shank which projects away from said ball and is slidably received through said rear opening in protrusion toward said front opening, a conduit being defined through said ball and said shank to deliver liquid into said interior;

a nut having means for connection to a delivery pipe and a snout enveloping said ball, the internal wall of said snout tapering inwardly to captivate said ball when the latter is urged outwardly relatively to said snout;

means for urging said ball outwardly relative to said snout when said connection means is attached to said pipe and for effecting a seal for said liquid;

means within the interior of said housing for captivating said shank against withdrawal from said rear opening, said captivating means seating said shank within said housing, permitting rotation of said housing around said shank;

means defined in said housing including said closure for creating first and second groups of flow outlets for said liquid;

first and second channels defined in said closure for enabling the flow of said liquid individually to respective different ones of said groups;

and a flow director secured to said shank for selecting the path of flow of said liquid as between said first and second channels as said housing is rotated around said shank.

2. A showerhead as defined in claim 1 in which said flow director is snap-fitted onto said shank, so as to remain oriented therewith as said housing is rotated around said shank.

3. A showerhead as defined in claim 1 in which said flow director is movably secured longitudinally on said shank but has a portion disposed in the path of flow inletted through said conduit as to be urged by that flow into selective cooperation with said channels.

4. A showerhead as defined in claim 1 in which said flow director includes a pair of space-opposed legs which engage over the inner end portion of said shank, and in which a pair of space-opposed lugs, which project outwardly from said end portion, define a pair of space-opposed channels in which individual ones of said legs respectively are seated.

5. A showerhead comprising:

a generally hollow housing having front and rear openings leading to the interior of said housing;

a closure affixed within said front opening and defining outlets for directing liquid in a selected spray pattern outwardly from said interior;

a pivot assembly including a ball in the form of a generally spherical segment and joined to a shank which projects away from said ball and is slidably received through said rear opening in protrusion toward said front opening, a conduit being defined through said ball and said shank to deliver liquid into said interior;

a nut having means for connection to a delivery pipe and a snout enveloping said ball, the internal wall of said snout tapering inwardly to captivate said ball when the latter is urged outwardly relatively to said snout;

means for urging said ball outwardly relative to said snout when said connection means is attached to said pipe and for effecting a seal for said liquid;

means within the interior of said housing for captivating said shank against withdrawal from said rear opening, said captivating means seating said shank within said housing, permitting rotation of said housing around said shank;

a removable restrictor inserted in said conduit for reducing the rate of flow of water into said housing below that which otherwise would be permitted by said conduit for a given water pressure;

said restricter including a tab which projects rewardly from said ball, so as to permit a user readily to remove said restricter upon removal of said showerhead from said delivery pipe and without disassembly of said showerhead;

and in which said restrictor is of oblong shape and effectively includes a pair of laterally-spaced webs which fit into said conduit and continue into end portions one of which enables removal of said restrictor from said conduit.

6. A showerhead as defined in claim 5 in which the central portion of said restrictor has a multi-faceted cross sectional shape, and said conduit includes a portion of receptive shape which enables randomly-selected orientation of said restrictor upon insertion while insuring accessibility for removal.

7. A showerhead comprising:

a generally hollow housing having front and rear openings leading to the interior of said housing;

a closure affixed within said front opening and defining outlets for directing liquid in a selected spray pattern outwardly from said interior;

a pivot assembly including a ball in the form of a generally spherical segment and joined to a shank which projects away from said ball and is slidably received through said rear opening in protrusion toward said front opening, a conduit being defined through said ball and said shank to deliver liquid into said interior;

a nut having means for connection to a delivery pipe and a snout enveloping said ball, the internal wall of said snout tapering inwardly to captivate said ball when the latter is urged outwardly relatively to said snout;

means for urging said ball outwardly relative to said snout when said connection means is attached to said pipe and for effecting a seal for said liquid;

means within the interior of said housing for captivating said shank against withdrawal from said rear opening, said captivating means seating said shank within said housing, permitting rotation of said housing around said shank;

a pair of space-opposed lugs projecting outwardly from the inner end portion of said shank;

a pair of space-opposed nubs projecting inwardly from a wall of said housing to define a pair of space-opposed channelways through which said lugs are receivable for disposition behind said nubs upon insertion and twisting of said shank relative to said housing;

and means disposable within said channelways for inhibiting untwisting of said shank relative to said housing that would enable withdrawal of said shank from said rear opening.

8. A showerhead comprising:

a generally hollow housing having front and rear openings leading to the interior of said housing;

a closure affixed within said front opening and defining outlets for directing liquid in a selected spray pattern outwardly from said interior;

a pivot assembly including a ball in the form of a generally spherical segment and joined to a shank which projects away from said ball and is slidably received through said rear opening in protrusion toward said front opening, a conduit being defined through said ball and said shank to deliver liquid into said interior;

a nut having means for connection to a delivery pipe and a snout enveloping said ball, the internal wall of said snout tapering inwardly to captivate said ball when the latter is urged outwardly relatively to said snout;

means for urging said ball outwardly relative to said snout when said connection means is attached to said pipe and for effecting a seal for said liquid;

means within the interior of said housing for captivating said shank against withdrawal from said rear opening, said captivating means seating said shank within said housing, permitting rotation of said housing around said shank;

a pair of space-opposed lugs projecting outwardly from the inner end portion of said shank;

a pair of space-opposed nubs projecting inwardly from a wall of said housing to define a pair of space-opposed channelways through which said lugs are receivable for disposition behind said nubs upon insertion and twisting of said shank relative to said housing;

and indexing means for inhibiting untwisting of said shank relative to said housing that would enable withdrawal of said shank from said rear opening.

* * * * *